US006058748A

United States Patent [19]

Beals, Jr. et al.

[11] Patent Number: 6,058,748

[45] Date of Patent: May 9, 2000

[54] SECURITY BRACKET

[75] Inventors: Harry C. Beals, Jr., Jackson; John A. Casolaro, Florham Park; Claude W. Duvall, Jr., Flanders; Edgar Lopes, Rahway, all of N.J.

[73] Assignee: Lucent Technologies Inc., Murray Hill, N.J.

[21] Appl. No.: 09/220,509

[22] Filed: Dec. 24, 1998

[51] Int. Cl.[7] ..... E05B 13/00

[52] U.S. Cl. ..... 70/203; 70/208; 70/212; 292/104; 292/205

[58] Field of Search ..... 70/203, 212, 208; 292/104, 106, 205, 148, 207

[56] References Cited

U.S. PATENT DOCUMENTS

| | | | |
|---|---|---|---|
| 385,668 | 7/1888 | Henninger | 292/207 X |
| 423,404 | 3/1890 | Cleveland | 292/207 X |
| 868,234 | 10/1907 | Tyden | 292/205 X |
| 1,058,829 | 4/1913 | Wilson | 292/207 |
| 1,124,882 | 1/1915 | Flickinger | 70/203 |
| 1,169,965 | 2/1916 | Kellogg | 70/212 |
| 1,185,618 | 6/1916 | Blanchard | 70/203 |
| 1,234,786 | 7/1917 | Miles | 292/207 |
| 1,423,562 | 7/1922 | Hill | 292/205 |
| 2,169,860 | 8/1939 | Von Hoorn | 70/203 |
| 2,177,249 | 10/1939 | Hammerly | 70/203 |
| 2,245,855 | 6/1941 | Fletcher | 292/205 X |
| 2,735,709 | 2/1956 | Thompson | 292/106 X |
| 3,270,536 | 9/1966 | Sprung | 292/207 X |
| 3,843,173 | 10/1974 | Harrell | 70/212 X |
| 4,335,595 | 6/1982 | Swan et al. | 70/472 X |
| 4,693,503 | 9/1987 | Bisbing | 292/210 |
| 4,978,816 | 12/1990 | Castonguay et al. | 70/203 X |
| 5,150,591 | 9/1992 | Norden, Jr. | 70/212 X |
| 5,692,401 | 12/1997 | Khalsa | 70/203 X |
| 5,743,118 | 4/1998 | ANderson | 70/203 X |
| 5,791,174 | 8/1998 | Fitzgerald et al. | 70/212 X |

FOREIGN PATENT DOCUMENTS

| | | | |
|---|---|---|---|
| 30000 | 12/1925 | France | 292/104 |
| 2443946 | 8/1980 | France | 70/203 |

*Primary Examiner*—Lloyd A. Gall

[57] ABSTRACT

A security bracket for use with a door latch mechanism of the type having a pivoting handle actuator disposed on the exterior of the door. The bracket is sandwiched between the door latch mechanism and the door and includes an opening through which the operating mechanism of the latch can extend through an opening in the door. The bracket includes a pair of tabs extending away from the door, each with an opening. A padlock shackle extends through the tab openings to overlie the door latch and prevent its operation.

3 Claims, 1 Drawing Sheet

SECURITY BRACKET

BACKGROUND OF THE INVENTION

This invention relates to cabinet locking arrangements and, more particularly, to a security bracket for preventing the operation of a door latch on a cabinet.

Outdoor cabinets containing communications equipment have in the past incorporated two hasps for security purposes. One of the hasps is welded to the front door and the other of the hasps is welded in close proximity to the first hasp on the cabinet, so that the shackle of a padlock can extended through holes in the two hasps to maintain the door in a closed condition. While effective, several problems occur with this type of arrangement. Since the hasps are welded to the cabinet and the front door, excessive heat from welding can cause the door and the cabinet to deform. This deformation can cause the cabinet to fail water intrusion and electromagnetic interference specifications. Manufacturability also is an issue, since misalignment of the two hasps is a common occurrence. Accordingly, there is a need for an effective construction for preventing activation of a door latch which avoids the problems discussed above.

SUMMARY OF THE INVENTION

According to this invention, there is provided a security bracket for use with a door latch mechanism of the type having a pivoting handle actuator disposed on the exterior of a door and a locking latch lever secured to the actuator and extending through an opening of the door to cooperate with a frame. The security bracket consists of a planar plate portion formed with an opening and a pair of parallel tabs orthogonal to the plate portion and spaced sufficiently to allow the handle actuator to pivot therebetween about an axis orthogonal to the tabs. Each of the tabs has a respective opening therethrough with the tab openings being aligned along a line extending orthogonal to the tabs. When in use, the inventive security bracket is sandwiched between the door latch mechanism and the door exterior with the latch lever extending through the plate portion opening of the security bracket and the line between the tab openings overlying the handle actuator. Accordingly, a shaft inserted through the tab openings locks operation of the handle actuator.

In accordance with an aspect of this invention, the security bracket is of unitary construction.

In accordance with another aspect of this invention, the security bracket further includes at least one rib joining each tab to the plate portion.

BRIEF DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION

Figure 2:
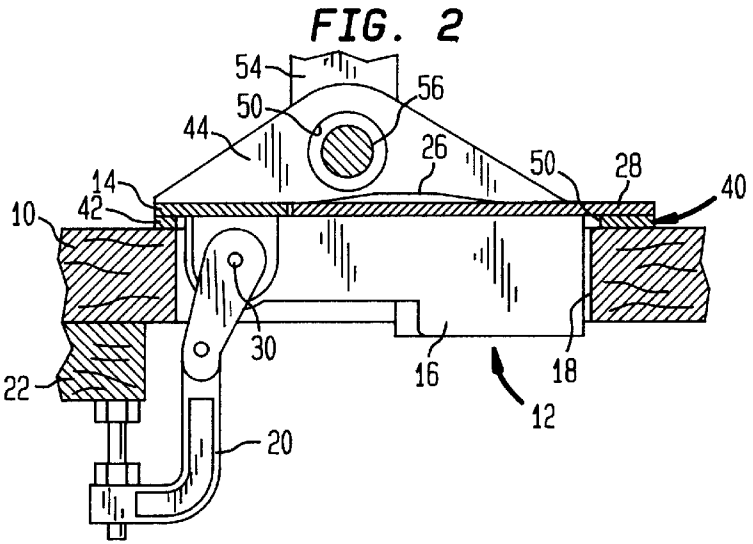
FIG. 2 is a cross sectional view along the line 2—2 of FIG. 1.
Figure 1:
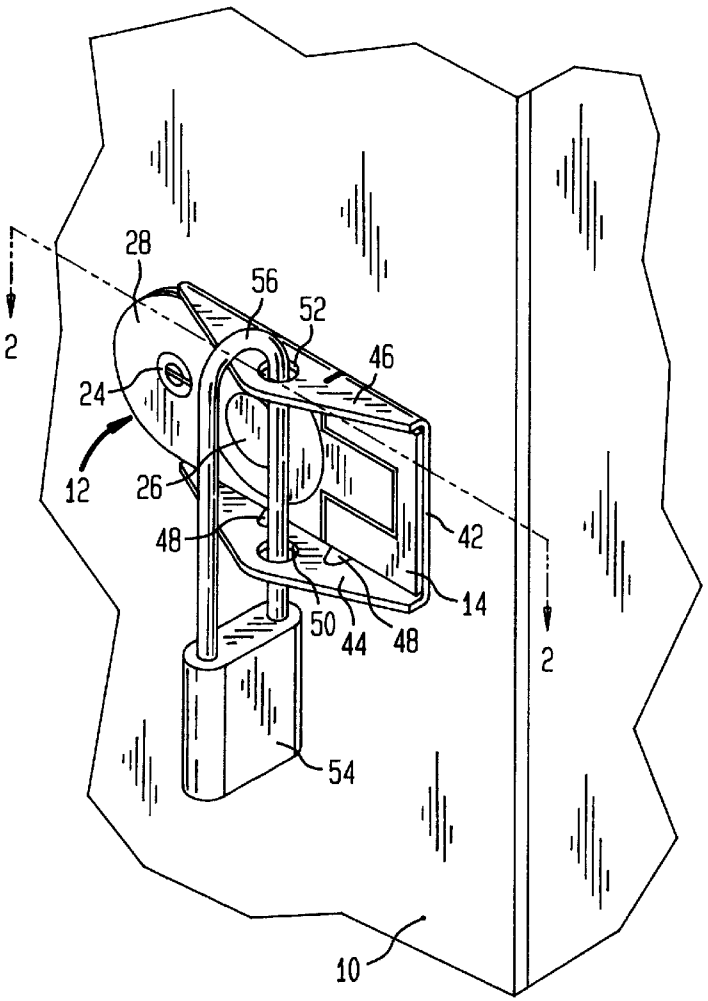
FIG. 1 is a perspective view showing a cabinet having mounted thereon a door latch mechanism of the type having a pivoting handle actuator, wherein a security bracket according to this invention, along with a long shackle padlock, prevents operation of the handle actuator.

Referring now to the drawings, shown in FIG. 1 is a portion of a cabinet having a door 10 to which is mounted a latch mechanism 12. The latch mechanism 12 is illustratively of the type known as a sealed lever latch manufactured by Southco, Inc., of Concordville, Pa. and identified by the Model No. C5-0-32130-03. Such a latch mechanism 12 has a plate 14 mounted to the exterior of the door 10 and an operating mechanism 16 extending through an opening 18 in the door 10. The latch mechanism 12 includes a lever 20 which cooperates with a frame 22 of the cabinet to prevent the door from opening, as best seen in FIG. 2. The latch mechanism 12 is mounted to the door 10 by brackets (not shown) inside the door to prevent its unauthorized removal. To operate the latch mechanism 12, a key is inserted in a keyhole 24 to unlock the latch mechanism. An actuator button 26 is then depressed to release the pivoting handle 28. The handle 28 is connected to the lever 20 so that when the handle 28 is pivoted about the pivot axis 30, the lever 20 is moved away from the frame 22 to allow the door 10 to be opened.

Figure 3:
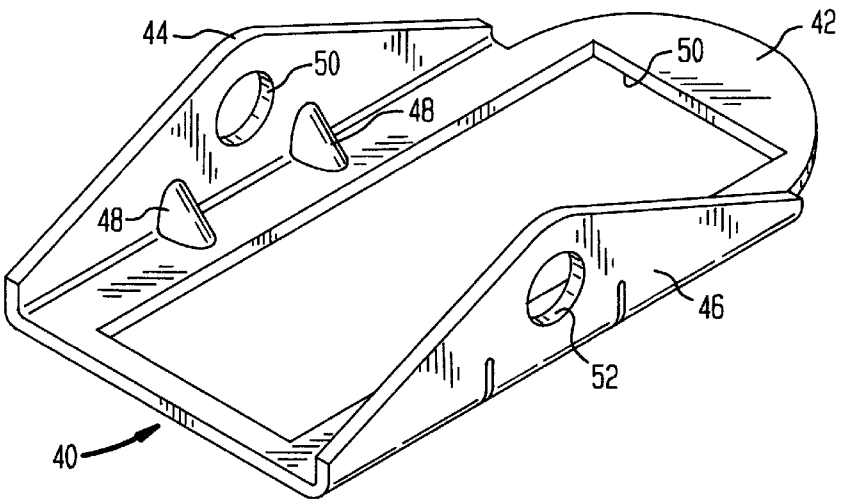
FIG. 3 is a perspective view of an embodiment of the security bracket according to the present invention.

FIG. 3 illustrates an embodiment of a security bracket according to the present invention, and designated generally by the reference numeral 40, which is adapted to be sandwiched between the latch mechanism 12 and the outside of the cabinet door 10. As shown, the bracket 40 includes a generally planar plate portion 42 and a pair of generally planar and parallel tabs 44, 46 extending orthogonally to the plate portion 42. Preferably, the bracket 40 is formed unitarily with the tabs 44, 46 being bent away from the plate portion 42. To provide increased strength, ribs 48 are formed between each of the tabs 44, 46 and the plate portion 42. To accommodate the latch mechanism 12, the plate portion 42 is formed with an opening 50. The opening 50 is sized substantially the same as the opening 18 in the door 10 through which the operating mechanism 16 of the latch mechanism 12 extends. Each of the tabs 44, 46 is formed with a respective opening 50, 52 which are aligned along a line orthogonal to the tabs 44, 46.

In use, the latch mechanism 12 is placed over the plate portion 42 between the tabs 44, 46, with the operating mechanism 16 extending through the opening 50. The bracket 40 is sized so that the latch mechanism 12 fits between the opposed sets of ribs 48. The subassembly of the latch mechanism 12 and the bracket 40 is then secured to the door 10 by the brackets normally used with the latch mechanism 12, with the plate portion 42 being sandwiched between the plate 14 of the latch mechanism 12 and the exterior of the cabinet door 10. When it is desired to lock the door 10, a padlock 54 with a long shackle 56 is utilized. The shackle 56 is placed through the openings 50, 52. The illustrative latch mechanism 12 is of the type where the actuator button 26 "pops up" after it is depressed. The shackle 56 prevents such action of the actuator button 26. In the event the actuator button 26 does pop up, the shackle 56 prevents the handle 28 from pivoting about the axis 30 to release the lever 20 from the frame 22.

The bracket 40 is illustratively formed of stainless steel, which is advantageous for outdoor use, although a variety of other materials may be utilized. Installation of the bracket 40 is very simple, requiring no welding which could deform the door 10. In addition, the bracket 40 can be used to retrofit existing latch mechanisms 12.

Accordingly, there has been disclosed an improved security bracket for use with a door latch mechanism. While an illustrative embodiment of the present invention has been disclosed herein, it is understood that various adaptations and modifications to the disclosed embodiment are possible and it is intended that this invention be limited only by the scope of the appended claims.

What is claimed is:

1. In combination with a door having a latch mechanism secured thereto for cooperation with a frame to maintain said door in a closed configuration, with said latch mechanism having an actuator accessible to selectively release said latch mechanism from said frame to allow said door to be moved to an open configuration, and wherein said latch mechanism includes a plate on the exterior of the door and an operating mechanism extending from said plate and through an opening through the door, a security bracket comprising:

a generally planar plate portion; and a pair of generally planar and parallel tabs extending orthogonally to said plate portion, said pair of tabs being spaced sufficiently to receive said latch mechanism therebetween with each of said tabs having an opening therethrough, said tab openings being aligned along a line orthogonal to said pair of tabs;

wherein said security bracket plate portion is formed with an opening sized substantially the same as and in registration with the opening through the door and is sandwiched between said latch mechanism plate and the exterior of said door with said line overlying said latch mechanism actuator and said operating mechanism of said latch mechanism extending through said bracket plate portion opening;

whereby when a shaft is inserted through the tab openings the actuator is blocked by the shaft.

2. The combination according to claim 1 wherein said security bracket is of unitary construction.

3. The combination according to claim 2 wherein said security bracket further comprises at least one rib joining each tab to said plate portion.

* * * * *